United States Patent [19]

Goto

[11] Patent Number: 4,817,493

[45] Date of Patent: Apr. 4, 1989

[54] WEAR-INDICATING PIERCER PIN FOR EXPLOSIVELY-OPERATED TOOLS

[75] Inventor: Kazuhiro Goto, Markham, Canada

[73] Assignee: AMP Incorporated, Harrisburg, Pa.

[21] Appl. No.: 164,709

[22] Filed: Mar. 4, 1988

[51] Int. Cl.[4] ..... F41F 13/00; F41C 27/00; F41D 11/04; F41D 11/16

[52] U.S. Cl. ..... 89/1.14; 42/69.01

[58] Field of Search ..... 42/69.01, 69.02, 1.01, 42/106; 89/1.14; 102/531

[56] References Cited

U.S. PATENT DOCUMENTS

| | | | |
|---|---|---|---|
| 552,699 | 1/1896 | Richardson | 42/69.01 |
| 2,421,769 | 6/1947 | Wolfe | 89/1.14 |
| 2,491,516 | 12/1949 | Piggot et al. | 89/1.14 |
| 3,292,363 | 12/1966 | Wahl | 42/46 |

*Primary Examiner*—David H. Brown
*Attorney, Agent, or Firm*—Allan B. Osborne

[57] ABSTRACT

A wear indicating piercer pin for use with explosively-operated industrial tools. More particularly, the piercer pin includes a passage extending from the rear face to a location just short of the leading tip end so that upon the tip end wearing down, the passage will become exposed.

1 Claim, 2 Drawing Sheets

WEAR-INDICATING PIERCER PIN FOR EXPLOSIVELY-OPERATED TOOLS

FIELD OF THE INVENTION

This invention relates to explosively-operated industrial tools having a piercer pin for releasing gases generated by denoting a cartridge therein.

BACKGROUND OF THE INVENTION

It was found with early explosively-operated tools not having a gas release that the cartridge in the firing chamber was difficult to remove due to the gas pressure from the detonation. This problem was remedied by the inclusion of a piercer pin and passages in the breech cap so that the pin pierces the cartridge upon closing the chamber, and after firing, as the breech cap is backed off slightly, the gases escape through the hole in the cartridge and out through the passages in the breech cap. U.S. Pat. No. 3,292,363, incorporated herein by reference, discloses the piercer pin and passages. Although the disclosed piercer pin and passages solved the problems, it subsequently was found that the pin would wear and not penetrate the cartridge so that the gases could not escape.

It is now proposed to provide a piercer pin which incorporates a way to determine its wear prior to its becoming ineffective.

SUMMARY OF THE INVENTION

According to the invention, a piercer pin is provided with a passage extending into the pin from the rear face and stopping short of the leading tip end so that the passage became exposed upon the tip end wearing down and permitting the escape of gases during the detonation of the cartridge.

DESCRIPTION OF THE INVENTION

Figure 1:
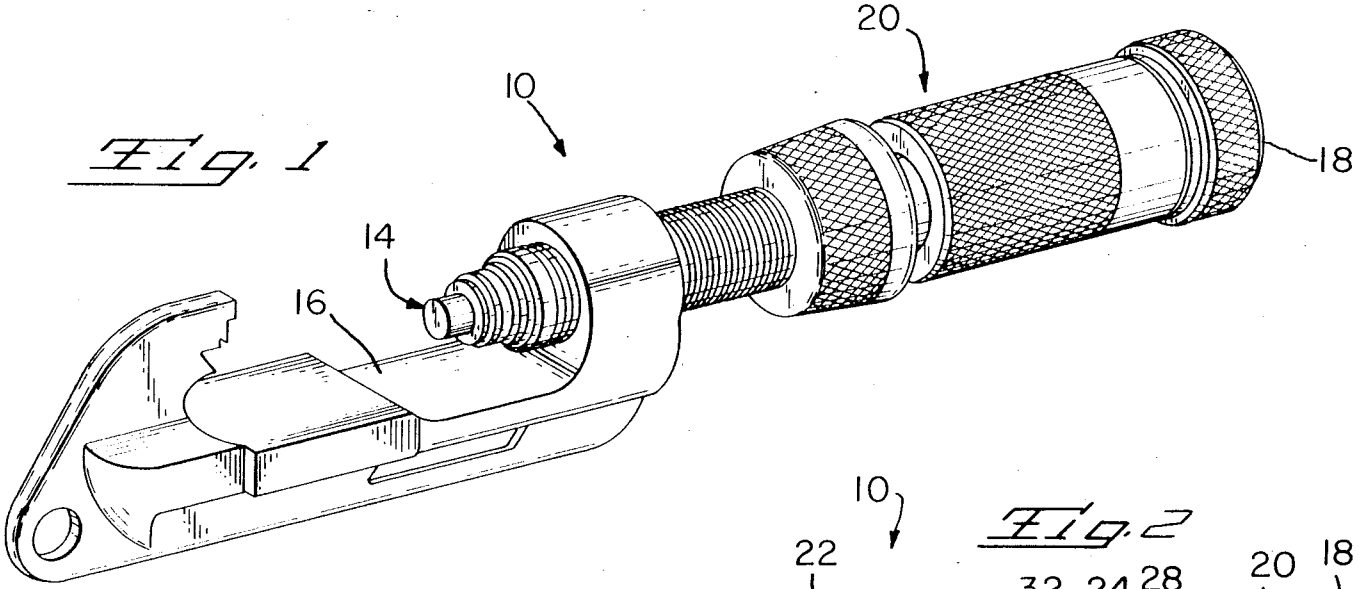
FIGS. 1 and 2 are respectively perspective and cross-sectional views of an explosively-operated, industry tool utilizing a piercer pin to release gases generated by igniting a cartridge.
Figure 2:
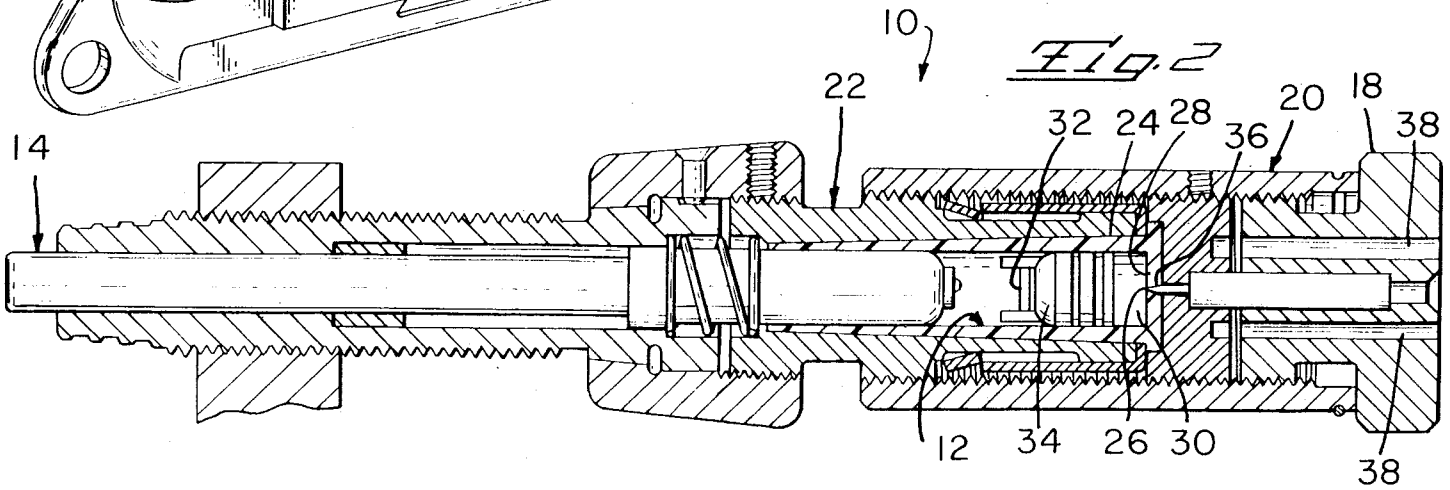

Tool 10 shown in FIGS. 1 and 2 uses gases generated by denotating cartridge 12 to drive ram 14 forward to engage a work piece (not shown) positioned on platform 16. In operation, with breech cap 18 unthreaded a few turns, breech 20 is disassembled from barrel 22 and cartridge 12 loaded into chamber 24. After breech 20 and barrel 22 are reunited, breech cap 18 is tightened and in so doing, piercer pin 26 pierces through base 28 of cartridge 12 into powder space 30. Cartridge 12, which is made from plastic, is detonated by rapping sharply on breech cap 18 so that ram 14 moves rearwardly, engaging and detonating primer 32. Flame from primer 32 travels through a passage (not shown) in plug 34 and ignites the powder (not shown) in space 30. The steps of removing apart cartridge 12 begins by unthreading breech cap 18 enough to withdraw piercer pin 26 to allow the gases to escape through hole 36 made in base 28 by pin 26 and through passages 38 in breech cap 18.

Figure 3:
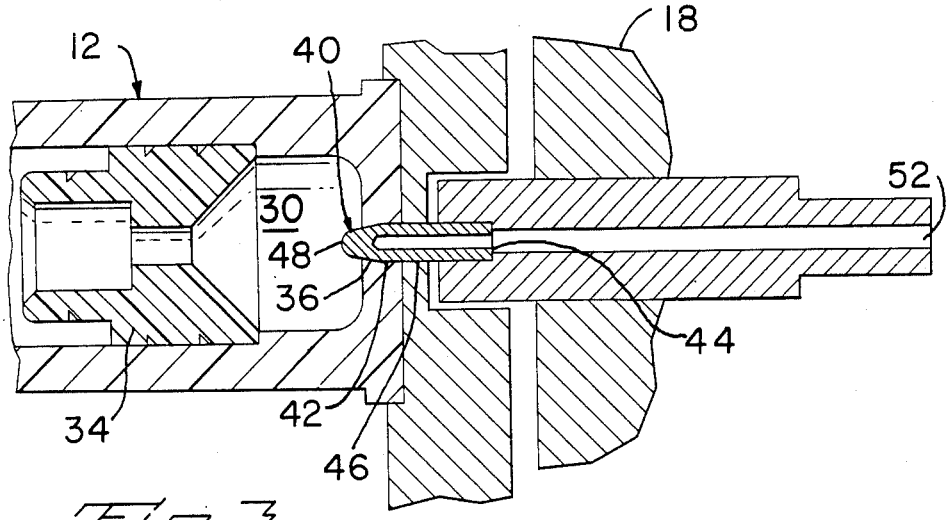
FIG. 3 is a cross-sectional view of the piercer pin of the present invention.

As noted above, should piercer pin 26 wear down to where it does not effectively penetrate base 28, loosening breech cap 18 will not release the gases. With reference to FIG. 3, piercer pin 40 shown therein provides a means for indicating wear thereon so that a new pin 40 may replace the worn one. As shown, pin 40 is provided with passage 42 which is open at rear face 44 of pin 40 and terminates within body 46 at a predetermined location remote from leading tip end 48.

Figure 3A:
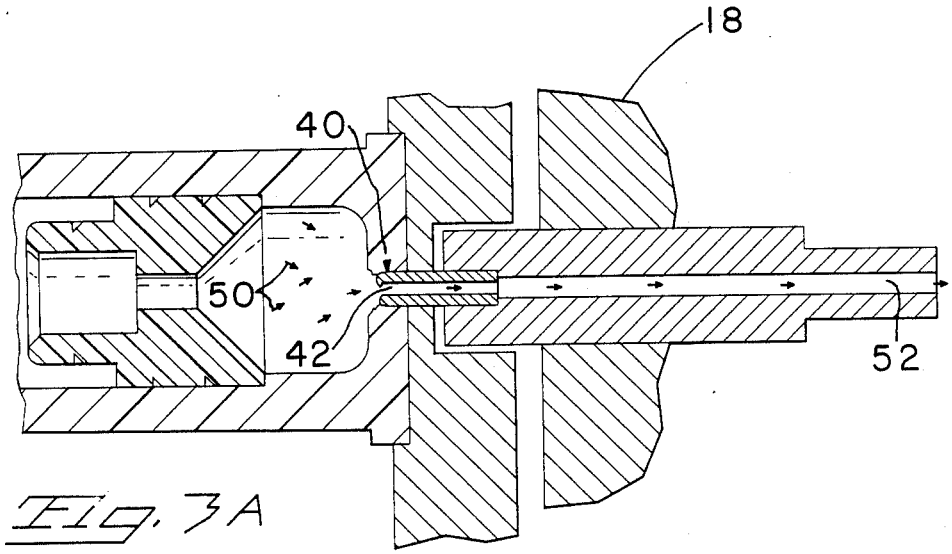
FIG. 3A is the same view as FIG. 3 but with a worn piercer pin.

In operation, tip end 48 wears down by erosion from the burning powder (not shown), from wear occasioned by being pushed through basses 28 or from a combination of both causes and eventually cannot pierce base 28 completely. However, by the time tip end 48 is worn down to passage 42, pin 40 is still capable of penetrating base 28 except for a thin layer of plastic. Thus, the burning powder will burn through the thin layer as shown in FIG. 3A and the gases, indicated by small arrows 50, will exit tool 10 through passage 42 in pin 40 and passage 52 in breech cap 18 without the latter being loosened. The escape will be minimal so as not to effect the driving force on ram 14 or harm the operator. However, the explosive noise of its escape and the odor will be enough to alert the operator so that he can take corrective action immediately.

Figure 4:
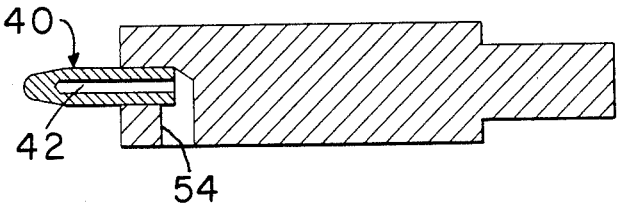
FIG. 4 is a cross-sectional view of the piercer pin mounted in an alternative breech cap.

FIG. 4 illustrates a modified breech cap 18 in which passage 52 has been replaced with passage 54 which is normal to the axis of pin 40. The effect of this modification is to make the exiting gases follow a more circuitous path so that the release rate is lower and the impact on moving ram 14 even more minimal.

As noted above, passage 42 ends at a distance rearwardly from tip end 48. This distance is such that passage 42 becomes exposed at the point where tip end 48 just barely fails to completely pierce base 28 of a given cartridge 12. That is, the remaining amount of plastic material must be thin enough to permit being burnt through.

As can be discerned, a wear-indicating piercer pin has been disclosed. The piercer pin is provided with a passage in the body thereof which opens onto the rear face but stops short of the leading tip end. As the tip end wears, the passage becomes open at that end and the gases from the burning powder escape without loosening the breech cap, thus signaling the operator of the wear.

I claim:

1. A wear indicating piercer pin for explosively operated industrial tools of the type employing a cartridge containing a powder charge remote from a base thereof and wherein the cartridge base is penetrated by the piercer pin to permit escape of gases subsequent to detonating the powder charge and upon slight withdrawal of the pin, said piercer pin comprising an elongated body with a rear face, a leading tip end and a passage extending from said rear face into said body to a predetermined location rearwardly from said leading tip end so that upon said leading tip end wearing down, said passage will be exposed.

* * * * *